US007700027B2

(12) United States Patent
Neal et al.

(10) Patent No.: US 7,700,027 B2
(45) Date of Patent: Apr. 20, 2010

(54) CREPING AID COMPOSITION AND METHODS FOR PRODUCING PAPER PRODUCTS USING THAT SYSTEM

(75) Inventors: Charles William Neal, Fairfield, OH (US); Edward Aprahamian, Jr., Cincinnati, OH (US); James Allen Cain, Leesburg, GA (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/266,011

(22) Filed: Nov. 6, 2008

(65) Prior Publication Data

US 2009/0056893 A1 Mar. 5, 2009

Related U.S. Application Data

(62) Division of application No. 10/910,047, filed on Aug. 3, 2004.

(60) Provisional application No. 60/492,555, filed on Aug. 5, 2003.

(51) Int. Cl.

| | |
|---|---|
| ***D21H 21/14*** | (2006.01) |
| ***D21H 17/33*** | (2006.01) |
| ***D21H 17/36*** | (2006.01) |
| ***D21H 17/54*** | (2006.01) |
| ***D21H 27/02*** | (2006.01) |
| ***B31F 1/12*** | (2006.01) |

(52) U.S. Cl. ..... 264/283; 525/56; 525/178; 525/55; 525/185; 162/111; 162/112; 156/183

(58) Field of Classification Search ..... 525/56, 525/178, 55, 185; 162/111, 112; 264/283; 156/183

See application file for complete search history.

(56) References Cited

U.S. PATENT DOCUMENTS

| | | | | |
|---|---|---|---|---|
| 3,926,716 | A | | 12/1975 | Bates |
| 4,501,640 | A | | 2/1985 | Soerens |
| 4,528,316 | A | | 7/1985 | Sorens |
| 4,788,243 | A | | 11/1988 | Soerens |
| 4,994,146 | A | | 2/1991 | Soerens |
| 5,025,046 | A | | 6/1991 | Soerens |
| 5,187,219 | A | | 2/1993 | Furman, Jr. |
| 5,234,547 | A | * | 8/1993 | Knight et al. ..... 162/111 |
| 5,338,807 | A | | 8/1994 | Espy et al. |
| 5,490,903 | A | | 2/1996 | Chen et al. |
| 5,494,554 | A | | 2/1996 | Edwards et al. |
| 5,786,429 | A | | 7/1998 | Allen |
| 5,865,950 | A | | 2/1999 | Vinson et al. |
| 5,902,862 | A | | 5/1999 | Allen |
| 5,942,085 | A | * | 8/1999 | Neal et al. ..... 162/111 |
| 5,944,954 | A | | 8/1999 | Vinson et al. |
| 6,048,938 | A | | 4/2000 | Neal et al. |
| 6,187,138 | B1 | | 2/2001 | Neal et al. |
| 2003/0003154 | A1 | | 1/2003 | De La Poterie |
| 2005/0028954 | A1 | | 2/2005 | Neal et al. |

* cited by examiner

*Primary Examiner*—Kelechi C Egwim
(74) *Attorney, Agent, or Firm*—Betty J. Zea

(57) ABSTRACT

The present invention relates to a creping aid composition comprising a film-forming semi-crystalline polymer and a vehicle system comprising a cationic polymer resin, a water soluble anionic film forming polymer, and water, wherein the net Mutek charge of the vehicle system is less than about −200 μeq/g solid and the pH of the creping aid composition is greater than the pH of the vehicle system. The present invention also relates to methods of producing paper products comprising the steps of a) providing a fibrous structure having a first surface and a second surface; b) providing a drying surface; c) applying a creping aid composition whereby the creping aid composition contacts one of the drying surface or the fibrous structure, said creping aid composition comprising i) a film-forming semi-crystalline polymer and ii) a vehicle system comprising a cationic polymer resin, a water-soluble anionic film-forming polymer, and water, wherein the net Mutek charge of the vehicle system is less than about −200 μeq/g solid and the pH of the creping aid composition is greater than the pH of the vehicle system; d) applying the fibrous structure to the drying surface such that the fibrous structure, the creping aid composition and the drying surface are all in contact; e) removing the fibrous structure from the drying surface.

11 Claims, 1 Drawing Sheet

CREPING AID COMPOSITION AND METHODS FOR PRODUCING PAPER PRODUCTS USING THAT SYSTEM

CROSS REFERENCE TO RELATED APPLICATIONS

This application is a Divisional of prior U.S. application Ser. No. 10/910,047, filed Aug. 3, 2004, which claims the benefit of U.S. Provisional Application No. 60/492,555 filed Aug. 5, 2003.

FIELD OF THE INVENTION

This invention relates to a new process for producing creped paper products which results in improved paper quality and process stability and cleanliness.

BACKGROUND OF THE INVENTION

Enhancing the softness of paper products such as tissue and toweling is desirable. Softness is the tactile sensation a user perceives as the user holds, rubs or crumples a particular paper product. This tactile sensation is provided by a combination of several physical properties including the bulk, stiffness and stretchability of the paper.

Creping, a process which is well known in the art, is a means of mechanically foreshortening a fibrous structure in the machine direction in order to enhance the softness, bulk and stretchability of the paper. Creping is generally accomplished with a flexible blade, known as a creping blade, which is placed against a drying surface such as a Yankee dryer. The fibrous structure adheres to the Yankee dryer as it contacts the dryer surface. The web travels along the surface of the Yankee dryer until it is removed by the creping blade. The degree to which the fibrous structure adheres to the Yankee dryer prior to creping is a key factor in determining the degree of softness, bulk, and stretchability exhibited by the fibrous structure after creping.

The level of adhesion of the fibrous structure to the Yankee surface is critical as it relates to the drying of the web. Higher levels of adhesion in combination with relatively low levels of coating build-up on the Yankee dryer surface permit better heat transfer. "Coating build-up" refers to the accumulation of film which builds up on the surface of the Yankee dryer after repeated adhesion/removal creping cycles. The coating build-up results from creping aids applied to the Yankee drum and from materials transferred out of the fibrous structure onto the surface of the Yankee dryer during the drying process (i.e.; hemicelluloses, fines and fiber fragments, wet end chemical additives, and the like). This improved heat transfer enables the web to dry faster, thus allowing the operation to run at higher speeds. Creping aids are preferably applied to the surface of the Yankee dryer to further facilitate the adhesion/creping process.

The level of adhesion of the fibrous structure to the Yankee surface is also important as it relates to the control of the web in its travel from the creping blade to the reel of the paper machine (i.e.; sheet control). Fibrous structures which are insufficiently adhered to the surface of the Yankee dryer are generally difficult to control and often result in quality problems at the reel such as wrinkling, fold-overs and weaved edges. Poor dry end sheet control affects the reliability of the entire papermaking process and subsequent converting operation.

It is important that the creping aid allow for a proper balance between adhesion of the fibrous structure to the drying surface and the release of the fibrous structure at the creping blade. Historically, one of the difficulties encountered with the use of creping aids has been a tendency for the creping aid to form a bond between the fibrous structure and the drying surface at the point of creping such that the fibrous structure does not properly release from the drying surface. This results in portions of the fibrous structure remaining adhered to the surface thus causing defects in the fibrous structure or causing the fibrous structure web to break. One such defect familiar to those of ordinary skill in the art is known as creping blade pickout. Creping blade pickout causes holes in the fibrous structure and increased coating related sheet breaks on the paper machine.

The maintenance of this critical balance has resulted in much development in the area of creping aids. Glues or adhesives such as cationic starches, hemicelluloses, and polyvinyl alcohols are regularly used to increase adhesion. The use of cationic polymeric resins is also well known. For examples, please see U.S. Pat. No. 4,501,640 issued to Soerens on Feb. 26, 1985; U.S. Pat. No. 5,187,219 issued to Furman, Jr. on Feb. 16, 1993; U.S. Pat. No. 5,494,554 issued to Edwards et al. on Feb. 27, 1996; U.S. Pat. No. 5,944,954 issued to Vinson et al. on Aug. 31, 1999; U.S. Pat. No. 5,942,085 issued to Neal et al. on Aug. 24, 1999; U.S. Pat. No. 6,048,938 issued to Neal et al. on Apr. 11, 2000; and U.S. Pat. No. 6,187,138 issued to Neal et al. on Feb. 13, 2001.

Process developments which deliver these components in separate spray boom applications have also been made as demonstrated in U.S. Pat. No. 5,865,950 issued to Vinson et al. on Feb. 2, 1999. Multiple spray booms are also used when both cationic and anionic materials are used in the creping step. The separate delivery systems have been developed to avoid precipitation of the resins in the delivery systems and spray booms. Newer paper-making machines are equipped with a "glue containment box" installed to control over-spray from the oscillating spray header. Glue over-spray has been identified as a problem with respect to maintaining a clean environment around the machine. However, it has been determined that the over-spray captured within the glue containment box resulted in precipitation of the cationic/anionic polymers, resulting in contamination and eventual plugging of the glue containment box.

Unfortunately, while a number of adhesives, including these examples have been disclosed and are available, no single adhesive or adhesive blend has provided a satisfactory combination of adhesion and sheet release, which do not precipitate in the delivery systems or the glue containment box.

SUMMARY OF THE INVENTION

The present invention relates to a creping aid composition comprising a film-forming semi-crystalline polymer and a vehicle system comprising a cationic polymer resin, a water soluble anionic film forming polymer, and water; wherein the net Mutek charge of the vehicle system is anionic. The present invention also relates to methods of producing paper products comprising the steps of a) providing a fibrous structure having a first surface and a second surface; b) providing a drying surface; c) applying a creping aid composition whereby the creping aid composition contacts one of the drying surface or the fibrous structure, said creping aid composition comprising i) a film-forming semi-crystalline polymer, and ii) a vehicle system comprising a cationic polymer resin, a water-soluble, anionic film-forming polymer; and water, wherein the net Mutek charge of the vehicle system is less than about −200 μeq/g solid and the pH of the creping aid composition is greater than the pH of the vehicle system; d) applying the fibrous structure to the drying surface such that the fibrous structure, the creping aid composition and the drying surface are all in contact; and e) removing the fibrous structure from the drying surface.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
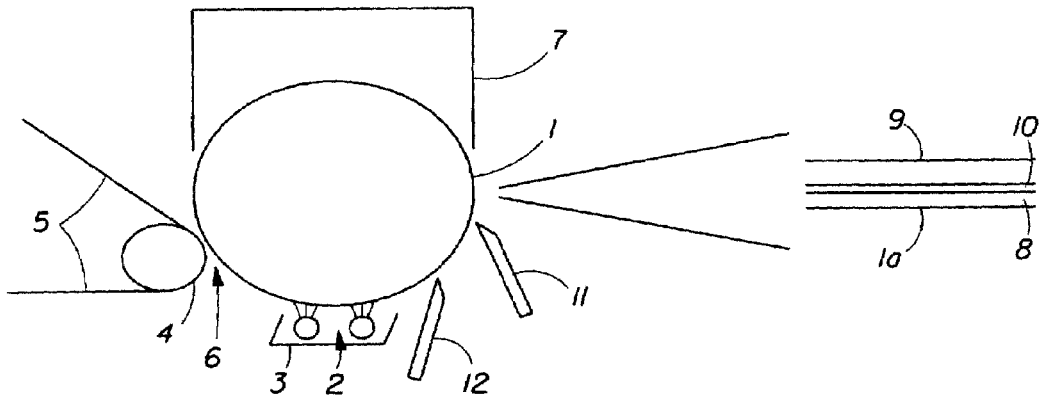
FIG. 1 is a simple side view schematic of the dry transfer/creping process.

The present invention relates to a creping aid composition comprising a film-forming semi-crystalline polymer and a vehicle system comprising a cationic polymer resin, a water soluble anionic film forming polymer, and water, wherein the net Mutek charge of the vehicle system is less than about −200 μeq/g solids and the pH of the creping aid composition is greater than the pH of the vehicle system. The present invention also relates to methods of producing paper products comprising the steps of a) providing a fibrous structure having a first surface and a second surface; b) providing a drying surface; c) applying a creping aid composition whereby the creping aid composition contacts one of the drying surface or the fibrous structure, said creping aid system comprising i) a film-forming semi-crystalline polymer, and ii) a vehicle system comprising a cationic polymer resin, a water-soluble anionic film-forming polymer, and water, wherein the net Mutek charge of the system is less than about −200 μeq/g solids and the pH of the creping aid composition is greater than the pH of the vehicle system; d) applying the fibrous structure to the drying surface such that the fibrous structure, the creping aid composition and the drying surface are all in contact; e) removing the fibrous structure from the drying surface.

The creping aid composition is used primarily in a papermaking process. While the composition may exist as a complete composition at any point in the making process, preferred embodiments of the composition are complete on the surface of a drying surface. The components of the composition may be delivered in one fluid mixture or may be delivered to the drying surface via multiple fluid mixtures, which are mixed together on the surface upon application.

As used herein, "Film-forming" means the characteristic of a material, when dried from a water solution, to form a thin continuous transparent or slightly opaque network or film having physical properties specific to films, such as modulus.

As used herein, "Semi-crystalline" means the characteristic of a material, when dried from a water solution, to form a polymer film, which can be described as having regions with highly ordered or crystalline structures blended with amorphous regions lacking the ordered structure found in crystalline regions.

As used herein, "Polymer" means any synthetic or natural compound of relatively high molecular weight consisting of many repeating linked units of relatively light or simple molecules.

As used herein, "Cationic" means the characteristic of a material as having positively charged functional groups.

As used herein, "Water soluble" means the characteristic of a material to be substantially dissolved into solution or dispersed into a stable coacervate, without forming an unstable precipitate, when mixed with water at the concentrations required by the application of the process.

As used herein, "Anionic" means the characteristic of a material as having negatively charged functional groups.

As used herein, "Net Mutek charge" means a charge value as measured by Mutek measurement devices known in the industry, where the charge value is an indication of a solution's anionic or cationic character. The net Mutek charge as applied to the present invention is measured on the combined ingredients of the vehicle system of the creping aid composition. So where the vehicle system may comprise two or more components, the Mutek charge measurement is performed on a mixture of the components mixed according to their respective flow rates as used in the papermaking process.

Creping Aid Composition

Film-forming Semi-Crystalline Polymer

The creping aid composition of the present invention comprises a film-forming, semi-crystalline polymer. Examples of the film-forming, semi-crystalline polymers may include, but are not limited to, hemicellulose, polyvinyl alcohol, and mixtures thereof. The film-forming, semi-crystalline polymer preferably comprises between about 30% and about 95% by weight of the total dry solids weight of the creping aid composition, and is most preferably between about 65% and about 90%. By "total dry solids" it is meant that the given percent is that percentage of the total weight of the film-forming semi-crystalline polymer plus the cationic polymer resin plus the water-soluble anionic film-forming polymer.

The concentration of the film-forming, semi-crystalline polymer in solution is dependent on the application process. Where the preferred process of spraying the creping aid composition is used, very dilute solutions are used. In such applications the percent total solids of any sprayed solution could range from 0.1% to 10%, preferably from about 0.5% to about 5%, and more preferably from about 1% to about 2%. In such preferred applications the film-forming, semi-crystalline polymer would comprise from about 0.03% to about 9.5%, preferably from about 0.65% to about 1.8%, of the sprayed composition.

Other application methods are within the scope of the present invention, such as application with a roller or sleeve. In such application the percent solids of the creping aid system could be much higher.

The preferred film-forming, semi crystalline polymer is polyvinyl alcohol. Any polyvinyl alcohol suitable to form an adhesive film can be employed in the present invention. The prior art, such as U.S. Pat. No. 3,926,716, describes the types of polyvinyl alcohol particularly suitable for the application. Commercial supplies of polyvinyl alcohol in solid form can be obtained under several trademarks including AIRVOL®, a trademark of Air Products Company of Allentown, Pa. and ELVANOL®, a trademark of E. I. duPont de Nemours of Wilmington, Del., and VINYLON®, a trademark of Wego Chemical & Mineral Corp. of Great Neck, N.Y. These resins can be readily made down into water to form aqueous solutions which are easily sprayed for application to a Yankee dryer or to a semi-dry tissue web.

If polyvinyl alcohol is used, the polyvinyl alcohol is preferably a hydrolyzed polyvinyl acetate with a degree of hydrolysis greater than about 88%, more preferably greater than about 98% and most preferably, ranging from about 99% to about 99.9%. The useful number average molecular weight range for the preferred polyvinyl alcohol is from about 90,000 to about 140,000. Viscosity is an indirect indicator of molecular weight, as used herein, referring to that of a 4% aqueous dispersion of the polyvinyl alcohol at 20° C. The preferred polyvinyl alcohol of the present invention preferably has a viscosity greater than about 20 centipoise (cP), more preferably greater than about 35 cP and most preferably greater than 50 cP.

Vehicle System

The creping aid composition of the present invention comprises a vehicle system comprising water, a cationic polymer resin, and a water-soluble anionic film-forming polymer.

Cationic Polymer Resin

The creping aid composition of the present invention comprises any cationic polymer resin. A variety of cationic polymer resins are known in the art. The cationic polymer resin preferably comprises between about 5% and about 95%, preferably between about 5% and 20% of the total dry weight of applied creping aid composition. As discussed above, where the preferred process of spraying the creping aid system is used, the total solids of any sprayed solution could range from 0.1% to 10%, preferably from about 0.5% to about 5%, and more preferably from about 1% to about 2%. In such preferred applications the cationic polymer resin would comprise from about 0.005% to about 9.5%, preferably from about 0.05% to about 0.4%, by weight of the sprayed composition. Possible cationic polymer resins include, but are not limited to, the following resins:

Water-soluble thermosetting cationic polyamide resins, including KYMENE® from Hercules, Inc. and CASCAMID® from Borden, are disclosed in U.S. Pat. No. 4,501,640. Cationic resins containing no secondary amines derived from reacting the polyamides of a dicarboxylic acid and methyl bis(3-aminopropylamine) in aqueous solution with epichlorohydrin in a mole ratio of between about 1:0.1 and about 1:0.33, including CREPETROL A3025® from Hercules, are disclosed in U.S. Pat. Nos. 5,942,085 and 6,048,938. Cationic resins characterized by a highly branched structure that lacks reactive intralinker functionality and which has a prepolymer backbone comprised of end capped polyamidoamine, including CREPETROL A6115® and A8115®, are disclosed in U.S. Pat. Nos. 5,786,429 and 5,902,862.

Water-Soluble Anionic Film-Forming Polymer

The creping aid composition of the present invention also comprises a water-soluble anionic film-forming polymer. The water-soluble anionic film-forming polymer preferably comprises between about 5% and about 20%, preferably between about 5% and 10% of the total dry weight of applied creping composition. Where the preferred process of spraying the creping aid system is used, the percent total solids of any sprayed solution could range from 0.1% to 10%, preferably from about 0.5% to about 5%, and more preferably from about 1% to about 2%. In such preferred applications the film-forming, semi-crystalline polymer would comprise from about 0.005% to about 2.0%, preferably from about 0.05% to about 0.2, by weight of the sprayed component.

The water soluble, anionic film forming polymer of this invention may preferably consist of a copolymer of styrene maleic anhydride disodium salt with an approximate M.Wt. of 120,000, acid number of 95 and 10% solution viscosity of 24 cP at pH 8.3. A preferred example of such a polymer is SCRIPSET 700® from Hercules, Inc., and is received as a 25% active solids solution and is metered directly into the line feeding the glue spray header. Another preferred example of a water-soluble, anionic film-forming polymer is carboxymethyl cellulose, including CMC 7MCT® from Hercules.

Net Mutek Charge

The vehicle system of the creping aid composition has a net Mutek charge that is less than about −200 μeq/g solid, preferably less than about −400 μeq/g-solid, more preferably less than about −600 μeq/g solid, and most preferably less than about −1000 μeq/g solid. Note that the Mutek charge measures the μeq per gram of dry solid in the vehicle system. It has surprisingly been found that traditional cationic creping aid resins, even highly thermosetting resins such as KYMENE®, may be used in creping aid systems along with anionic modifiers, without the problems related to precipitation on the paper machine.

ph Modifiers

It is critical that the vehicle system of the present invention have the anionic Mutek charge character as described above. Control of the pH of the creping aid composition is also critical to the prevention of precipitation of the solids of the composition. The pH of the creping aid composition must be greater than or equal to the vehicle system. Some combinations of cationic resin and anionic polymer may not achieve that anionic character upon simple mixture. In such cases it may be necessary to increase the anionic character of the vehicle system or the final pH of the creping aid composition by the addition of pH modifiers. Such modifiers are optional and are those compounds known in the art to raise the pH of solutions. These include, but are not limited to, sodium hydroxide, which is thepreferred modifier.

Optional Ingredients

Optionally, the creping aid composition of the present invention may also include a modifier. Modifiers are used to alter the adhesion/creping/build-up characteristics of the coating formed on the surface of the Yankee dryer resultant from the application of the creping aid to the Yankee dryer surface. Suitable modifiers include hydrocarbon oils, surfactants, and preferably plasticizers.

Surfactants and hydrocarbon oils function primarily by increasing the lubricity of the coating formed on the drying surface thereby modifying the release characteristics of the coating. Surfactants and hydrocarbon oils tend not to be fully compatible with the other components of the creping aid. When added as a component of the creping aid composition, there is a tendency for the surfactant or hydrocarbon oil to separate out from the rest of the creping aid solution thereby forming a two phase creping aid solution which in turn decreases the overall efficacy of the creping aid.

Furthermore, this incompatibility will also negatively impact the quality of the coating formed on the drying surface. While not wishing to be constrained by theory, it is believed that both surfactants and oils will form an oil film at the interface of the coating and the fibrous structure resulting in a loss of adhesion of the fibrous structure to the surface of the Yankee dryer.

Conversely, a plasticizer tends to be fully compatible with the creping aid. The plasticizer of this invention, which forms a stable dispersion in water, is compatible with the other components of the creping aid of this invention. The plasticizer functions by reacting with the other components of the creping aid so as to soften the coating formed on the surface of the Yankee dryer. The plasticizer of this invention has a swelling ratio of at least 0.10 and a solubility parameter greater than 20 $MPA^{1/2}$. Suitable plasticizers include propylene glycol, diethylene glycol, triethylene glycol dipropylene glycol, glycerol, and preferably ethylene glycol. A preferred plasticizer, sold commercially as CREPETROL R 6390®, is available from Hercules.

Method of Producing Paper

Providing a Fibrous Structure

As used herein, "fibrous structure" refers to a fibrous material which may be comprised of cellulosic and noncellulosic components. These cellulosic and noncellulosic components which include papermaking fibers and other various additives are mixed with water to form an aqueous slurry. It is this aqueous slurry which constitutes the aqueous papermaking furnish. It is anticipated that wood pulp in all its varieties will normally comprise the papermaking fibers used in this invention. However, other cellulose fibrous pulps, such as cotton linters, bagasse, rayon, etc., can be used and none are disclaimed. Wood pulps useful herein include chemical pulps such as, sulfite and sulfate (sometimes called kraft) pulps as well as mechanical pulps including for example, groundwood, thermomechanical pulp (TMP) and chemithermomechanical pulp (CTMP).

Both hardwood pulps and softwood pulps as well as combinations of the two may be employed as papermaking fibers for the present invention. The term "hardwood pulps" as used herein refers to fibrous pulp derived from the woody substance of deciduous trees (angiosperms), whereas "softwood pulps" are fibrous pulps derived from the woody substance of coniferous trees (gymnosperms). Pulps from both deciduous and coniferous trees can be used. Blends of hardwood kraft pulps, especially eucalyptus, and northern softwood kraft (NSK) pulps are particularly suitable for making the tissue webs of the present invention. Another preferred embodiment of the present invention comprises layered tissue webs wherein, most preferably, hardwood pulps such as eucalyptus are used for outer layer(s) and wherein northern softwood kraft pulps are used for the inner layer(s). Also applicable to the present invention are fibers derived from recycled paper, which may contain any or all of the above categories of fibers.

Additives such as particulate fillers, including clay, calcium carbonate, titanium dioxide, talc, aluminum silicate, calcium silicate, alumina trihydrate, activated carbon, pearl starch, calcium sulfate, glass microspheres, diatomaceous earth, and mixtures thereof can also be included in the aqueous papermaking furnish.

Other additives, of which the following are examples, can be added to the aqueous papermaking furnish or the fibrous structure to impart other characteristics to the paper product or improve the papermaking process so long as they do not interfere or counteract the advantages of the present invention.

It is sometimes useful, for purposes of retention and web strength to include starch as one of the ingredients of the papermaking furnish, especially cationic starch. Particularly suitable starches for this purpose are produced by National Starch and Chemical Company, (Bridgewater, N.J.) under the tradename, REDIBOND®.

It is common to add a cationic charge biasing species to the papermaking process to control the zeta potential of the aqueous papermaking furnish as it is delivered to the papermaking process. One suitable material is CYPRO 514®, a product of Cytec, Inc. of Stamford, Conn.

It is also common to add retention aids. Multivalent ions can be effectively added to the aqueous papermaking furnish in order to enhance the retention of fine particles which might otherwise remain suspended in the recirculating water system of the paper machine. The practice of adding alum, for example, has long been known. More recently, polymers which carry many charge sites along the chain length have been effectively employed for this purpose. Both anionic and cationic flocculants are expressly included within the scope of the present invention. Flocculants such as RETEN 235®, a product of Hercules, Inc. of Wilmington, Del. and ACCURAC 171®, a product of Cytec, Inc. of Stamford, Conn. are examples of anionic flocculants. Flocculants such as RETEN 157®, a product of Hercules, Inc. of Wilmington, Del., and ACCURAC 91°, a product of Cytec, Inc. of Stamford, Conn. are examples of acceptable cationic flocculants.

The use of high surface area, high anionic charge microparticles for the purposes of improving formation, drainage, strength, and retention is well known in the art. See, for example, U.S. Pat. No. 5,221,435, issued to Smith on Jun. 22, 1993. Common materials for this purpose are silica colloid, bentonite clay, or organic microparticles. The incorporation of such materials is expressly included within the scope of the present invention.

The advantages of the present invention are most particularly realized for grades of paper without permanent wet strength. Wet strength resins, particularly the polyamide-epichlorohydrin type which are more particularly detailed in other parts of this specification, often provide some degree of crepe control even when added to the aqueous papermaking furnish. However, these advantages invariably are accompanied by the presence of permanent wet strength in the product, a property which is often a liability and addition of the polyamide-epichlorohydrin in the wet end of the papermaking process is not as effective in promoting crepe benefits as can be achieved by using the polymer directly in the creping operation.

Creped paper products, which must have limited strength when wet because of the need to dispose of them through toilets into septic or sewer systems, require fugitive wet strength resins. Fugitive wet strength resins impart a wet strength which is characterized by a decay of part or all of its potency upon standing in presence of water. If fugitive wet strength is desired, the binder materials can be chosen from the group consisting of dialdehyde starch or other resins with aldehyde functionality such as CO-BOND 1000® offered by National Starch and Chemical Company, PAREZ 750® offered by Cytec of Stamford, Conn. and the resin described in U.S. Pat. No. 4,981,557 issued on Jan. 1, 1991, to Bjorkquist.

If enhanced absorbency is needed, surfactants may be used to treat the creped tissue paper webs of the present invention. The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as CRODESTA SL-40® which is available from Croda, Inc. (New York, N.Y.); alkylglycoside ethers as described in U.S. Pat. No. 4,011,389, issued to W. K. Langdon, et al. on Mar. 8, 1977; and alkylpolyethoxylated esters such as PEGOSPERSE 200 mL® available from Glyco Chemicals, Inc. (Greenwich, Conn.) and alkylphenol ethoxylates such as IGEPAL RC-520® available from Rhone Poulenc Corporation (Cranbury, N.J.).

Chemical softening agents are expressly included as optional ingredients. Acceptable chemical softening agents comprise the well known dialkyldimethylammonium salts such as ditallowedimethylammonium chloride, ditallowedimethylammonium methyl sulfate, di(hydrogenated) tallow dimethyl ammonium chloride; with di(hydrogenated) tallow dimethyl ammonium methyl sulfate being preferred. This particular material is available commercially from Witco Chemical Company Inc. of Dublin, Ohio under the tradename VARISOFT 137®. Biodegradable mono and di-ester variations of the quaternary ammonium compound can also be used and are within the scope of the present invention.

The above listing of optional chemical additives is intended to be merely exemplary in nature, and is not meant to limit the scope of the invention.

Those skilled in the art will recognize that not only the qualitative chemical composition of the papermaking furnish is important to the creped papermaking process, but also the relative amounts of each component, and the sequence and timing of addition, among other factors. The following techniques are suitable in preparing the aqueous papermaking furnish, but its delineation should not be regarded as limiting the scope of the present invention, which is defined by the claims set forth at the end of this specification.

Papermaking fibers are first prepared by liberating the individual fibers into an aqueous slurry by any of the common pulping methods adequately described in the prior art. Refining, if necessary, is then carried out on the selected parts of the papermaking furnish.

In a preferred arrangement, a slurry of relatively short papermaking fibers, comprising hardwood pulp, is prepared, while a slurry of relatively long papermaking fibers is separately prepared. The fate of the resultant short fibered slurry is to be directed to the outer chambers of a three layered headbox to form surface layers of a three layered tissue in which a long fibered inner layer is formed out of an inner chamber in the headbox in which the slurry of relatively long papermaking fibers is directed. The resultant tissue web is particularly suitable for converting into a single-ply tissue product.

In an alternate preferred arrangement, the before-mentioned slurries of long and short fibers are formed and the fate of the resultant short fibered slurry is to be directed to one chamber of a two chambered headbox to form one layer of a two layered tissue in which a long fibered alternate layer is formed out of the second chamber in the headbox in which the slurry of relatively long papermaking fibers is directed. The resultant tissue web is particularly suitable for converting into a multi-ply tissue product comprising two plies in which each ply is oriented so that the layer comprised of relatively short papermaking fibers is on the surface of the two-ply tissue product.

Those skilled in the art will also recognize that the apparent number of chambers of a headbox can be reduced by directing the same type of aqueous papermaking furnish to adjacent chambers. For example, the before-mentioned three chambered headbox could be used as a two chambered headbox simply by directing essentially the same aqueous papermaking furnish to either of two adjacent chambers. Likewise, those operations utilizing a non-laying headbox are included within the scope of the present invention.

The fibrous structure of this invention may be made according to commonly assigned U.S. Pat. No. 3,926,716 issued to Bates on Dec. 16, 1975; U.S. Pat. No. 4,191,609 issued Mar. 4, 1980 to Trokhan; U.S. Pat. No. 4,300,981 issued to Carstens on Nov. 17, 1981; U.S. Pat. No. 4,191,609 issued to Trokhan on Mar. 4, 1980; U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,245,025 issued to Trokhan et al. on Sep. 14, 1993; U.S. Pat. No. 5,275,700 issued to Trokhan on Jan. 4, 1994; U.S. Pat. No. 5,328,565 issued to Rasch et al. on Jul. 12, 1994; U.S. Pat. No. 5,332,118 issued to Muckenfuhs on Jul. 26, 1994; U.S. Pat. No. 5,334,289 issued to Trokhan et al. on Aug. 2, 1994; U.S. Pat. No. 5,364,504 issued to Smurkowski et al. on Nov. 15, 1995; U.S. Pat. No. 5,527,428 issued to Trokhan et al. on Jun. 18, 1996; U.S. Pat. No. 5,556,509 issued to Trokhan et al. on Sep. 17, 1996; U.S. Pat. No. 5,628,876 issued to Ayers et al. on May 13, 1997; U.S. Pat. No. 5,629,052 issued to Trokhan et al. on May 13, 1997; and U.S. Pat. No. 5,637,194 issued to Ampulski et al. on Jun. 10, 1997.

The fibrous structure of the present invention may be conventionally wet pressed or preferably through-air dried. It may be foreshortened by creping or by wet microcontraction. Creping and wet microcontraction are disclosed in commonly assigned U.S. Pat. No. 4,440,597 issued to Wells et al. on Apr. 3, 1984 and U.S. Pat. No. 4,191,756 issued to Sawdai on May 4, 1980.

Providing a Drying Surface

The drying section is next in the papermaking apparatus after the pre-drying section. The drying section comprises a drying surface. The drying surface may be at ambient temperature or it may be heated. Referring to FIG. 1, any drying surface is suitable, however, a Yankee dryer 1 is preferable. The Yankee dryer 1 is generally steam heated. A drying hood 7 which circulates hot air by a means not shown may be positioned over the Yankee dryer 1 in an effort to further facilitate the drying operation. In the preferred embodiment, at least one creping aid spray boom shower 2 is juxtaposed with the Yankee dryer 1. A creping blade 11 is positioned against the surface of the Yankee dryer 1 so as to create an impact angle between the blade and the surface of the dryer wherein the impact angle ranges from about 70° to 90° and preferably from about 80° to 85°. An optional cleaning blade 12 may be utilized to remove contaminant buildup and excess coating from the surface of the Yankee dryer.

Applying the Creping Aid Composition

While various means of application of the creping aid composition are anticipated and none are disclaimed, the preferred method of applying the creping aid composition is to direct a dispersion of the system via spray boom directed at the surface of the Yankee dryer prior to transfer of the semi dry tissue paper web. Referring to FIG. 1, the application point of the creping aid composition via this preferred embodiment is represented by spray boom system 2. The amount of creping aid composition applied to the drying surface depends on the type of drying system and surface employed in the paper making process. For the preferred process of Yankee drying, the total applied solids from the creping aid composition can range from about 0.1 lb/ton to about 10 lb/ton based on the dry weight per dry weight of the paper web, preferably from about 2 lb/ton to about 8 lb/ton.

The process can be described at its most basic form in five phases. The first phase is the process of spraying the Yankee coating adhesive onto the surface of the Yankee dryer 1. This process may entail a single or preferable a dual spray boom 2 and may optionally include a glue containment box 3 which prevents over spray from contaminating other areas of the papermaking machine such as the pressure roll 4. A detailed description of a preferred process for the primary and secondary spray boom 2 configuration is summarized in Table 1.

TABLE 1

| Detailed of Glue Spray System | |
|---|---|
| Primary Boom | |
| Nozzle Size | 11002 VeeJet |
| No. of Nozzles | 24 |
| Pressure at Head | 55 psi |
| Flow per Nozzle | 0.23 gpm |
| Total Flow | 5.98 gpm |

TABLE 1-continued

| Detailed of Glue Spray System | |
|---|---|
| Secondary Boom | |
| Nozzle Size | 11001 VeeJet |
| No. of Nozzles | 23 |
| Pressure at Head | 32 psi |
| Flow per Nozzle | 0.09 gpm |
| Total Flow | 1.96 gpm |

The second phase is the dry transfer process where the sheet is transferred from the fabric or belt 5 to the surface of the Yankee dryer 1. This is accomplished by pressing the wet knuckles into the Yankee coating thereby causing adhesion of the sheet to the Yankee and release of the sheet from the belt 5. Pressure applied from the pressure roll 4 can vary. A typical pressure is 125 psi. Release of the sheet from the belt is facilitated by application of an oil based release aid onto the surface of the belt before the sheet is transferred to the belt. The level of moisture contained by the paper at this point is critical to determining the level of adhesion due to the phenomenon know as rewettability of the glue. This can be described as the tendency of the glue to become activated and forming a sticky surface for the paper to become attached to in the Yankee/pressure roll nip 6.

The third phase is the process of further drying the sheet by heat transfer from the steam heated Yankee shell 1 and impingement of hot air onto the sheet surface in the hood 7. During this phase, surface tension forces draw the fibers closer to one another producing the interfiber bonding which result in the paper's major strength properties. In an expanded area of the drawing one can see that the coating 8 acts as an adhesive layer between the formed sheet 9 and the hot surface of the yankee dryer 1*a*. The glue/sheet interphase 10 represents the penetration of the sheet into the yankee coating via action of the pressure roll and rewetting of the glue.

The fourth phase is the creping of the paper at the creping blade 11. The mechanical action of the blade 11 on the paper is the source of the wrinkled or creped paper, which gives the paper its softness and reduced strength properties compared to paper which has not been creped. The depth by which the blade 11 penetrates into the coating 8 is dependent on the physical and rheological properties of the coating.

Optionally, phase five is the application of a second blade, known as a cleaning blade 12, which removes excess coating thus extending the life of the creping blade 11 and preventing excessive build-up of glue/cellulose fines and fiber fragments on the Yankee surface 1*a* thus maintaining a relatively constant level of adhesion through the life of the creping doctor blade.

Applying the Fibrous Structure to the Drying Surface

The web is transferred from the foraminous carrier fabric to the Yankee dryer surface. At this point of transfer, the fibrous structure has a consistency of about 10% to 90%, preferably 45% to 75%, and more preferably 55% to 65%. The web is secured to the surface of the Yankee dryer by the pressure roll assisted by the creping aid composition. The fibrous structure is dried by the steam heated Yankee dryer and by hot air which is circulated through a drying hood.

Removing the Fibrous Structure from the Drying Surface.

The fibrous structure is removed from the surface of the Yankee dryer preferably by creping it from the surface with a creping blade. The fibrous structure then passes between calender rolls and is wound into a roll on a core disposed on a shaft.

The present invention is applicable to creped tissue paper in general and includes but is not limited to conventionally wet pressed creped tissue paper, high bulk pattern densified creped tissue paper and high bulk, uncompacted creped tissue paper.

EXAMPLES

An aqueous slurry of Northern Softwood Kraft (NSK) of about 3% consistency is made up using a conventional pulper and is passed through a stock pipe to a softwood pulp storage chest. An aqueous slurry of Eucalyptus hardwood (Euc) of about 3% consistency is made up using a conventional pulper and is passed through a stock pipe to a hardwood pulp storage chest. Additional storage chest are utilized for converting and machine broke. Converting broke in this application is segregated into tissue and towel broke and tissue only broke is used. Machine broke is collected on the dry end as a result of sheet breaks and time the sheet is run into the tub or machine repulper. Softwood pulp, converting broke and machine broke are delivered through stock pipes to a quick mix chest number 1. The softwood pulp is optionally passed through a refiner prior to addition to the quick mix chest number 1. The aqueous pulp slurry contained in quick mix 1 is passed through a stock pipe toward the center layer of a three layer headbox of the Fourdrinier. Eucalyptus pulp is passed through stock pipes to quick mix chest number 2. The aqueous pulp slurry contained in quick mix chest 2 is passed through separate stock pipes toward the outer two layers of the three layer headbox.

In order to impart a temporary wet strength to the finished product, a 15% solution of Parez750C available from Bayer Inc. is added to the stock supply pipe for each of the three furnish supply pipes with the majority added to the center or softwood layer. The adsorption of the temporary wet strength resin is enhanced by passing the treated slurry through an in-line mixer. Total level of temporary wet strength resin is 6-10 lbs/ton with 50-100% in the center softwood layer and 0-25% in each of the outer hardwood layers.

The NSK slurry and two eucalyptus fibers slurries of about 2.5% consistency are passed through the respective stock pipes and diluted with white water to about 0.15% consistency at the fan pump. The eucalyptus slurry and the NSK slurry are both directed to a layered headbox capable of maintaining the slurries as separate streams until they are deposited onto a forming wire on the Fourdrinier.

The paper machine has a layered headbox having a top chamber, a center chamber, and a bottom chamber. The eucalyptus fiber slurry is pumped through the top and bottom headbox chambers and, simultaneously, the NSK fiber slurry is pumped through the center headbox chamber and delivered in superposed relation onto the Fourdrinier wire to form thereon a three-layer embryonic web, of which about 70% is made up of the eucalyptus fibers and 30% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction direction monofilaments per inch, respectively. The embryonic web is transferred from the Fourdrinier wire, at a fiber consistency of about 22% at the point of transfer, to a patterned drying fabric.

The drying fabric is designed to yield a pattern-densified tissue with discontinuous low-density deflected areas arranged within a continuous network of high density (knuckle) areas. This drying fabric is formed by casting an impervious resin surface onto a fiber mesh supporting fabric.

The supporting fabric is a 48×52 filament, dual layer mesh. The thickness of the resin cast above the surface of the secondary is about 5.5 mils. The knuckle area is about 36% and the open cells are present at a frequency of about 575 per square inch.

After forming, the fibrous structure was through-air dried to a consistency of approximately 55-60% prior to transfer to the Yankee dryer. The web is then dried, creped, calendared and wound into a roll at the reel of the paper machine.

Creping Aid Compositions

The following table exemplified various embodiments of the creping aid compositions of the present invention.

| System 1 | System 2 | System 3 | System 4 |
|---|---|---|---|
| 1.2% PVOH<br>0.15% A-3025<br>0.15% Scripset 700<br>Water<br>NaOH to vehicle system<br>Mutek charge<br>to <−200 μeq/g.<br>pH of composition >/=<br>pH of vehicle system | 1.34% PVOH<br>0.075% A-3025<br>0.075% Scripset<br>Water<br>NaOH to vehicle system<br>Mutek charge<br>to <−200 μeq/g.<br>pH of composition >/=<br>pH of vehicle system | 1.2% PVOH<br>0.06% A-3025<br>0.24% Scripset<br>Water<br>No NaOH required.<br>Vehicle system Mutek<br>charge <−2500.<br>pH of composition >/=<br>pH of vehicle system | 1.2% PVOH<br>0.15% A-8115<br>0.15% Scripset<br>Water<br>No NaOH required.<br>Vehicle system Mutek<br>charge <−1500.<br>pH of composition >/=<br>pH of vehicle system |
| **System 5** | **System 6** | **System 7** | **System 8** |
| 1.2% PVOH<br>0.24% A-8115<br>0.06% Scripset 700<br>Water<br>No NaOH required.<br>Vehicle system Mutek<br>charge <−500.<br>pH of composition >/=<br>pH of vehicle system | 1.05% PVOH<br>0.225% A-3025<br>0.225% Scripset<br>Water<br>No NaOH required.<br>Vehicle System Mutek<br>charge <−500.<br>pH of composition >/=<br>pH of vehicle system | 1.2% PVOH<br>0.15% A-8115<br>0.15% CMC 7MCT<br>Water<br>No NaOH required.<br>Vehicle system Mutek<br>charge <−1000.<br>pH of composition >/=<br>pH of vehicle system | 1.2% PVOH<br>0.15% A-3025<br>0.15% CMC 7MCT<br>Water<br>NaOH to vehicle system<br>Mutek to<br>charge <−200 μeq/g.<br>pH of composition >/=<br>pH of vehicle system |
| **System 9** | **System 10** | **System 11** | **System 12** |
| 1.2% PVOH<br>0.15% A-6115<br>0.15% Scripset 700<br>Water<br>No NaOH required.<br>Vehicle system Mutek<br>charge <−500.<br>pH of composition >/=<br>pH of vehicle system | 1.2% PVOH<br>0.15% A-6115<br>0.15% CMC 7MCT<br>Water<br>No NaOH required.<br>Vehicle system Mutek<br>charge <−500.<br>pH of composition >/=<br>pH of vehicle system | 1.2% PVOH<br>0.15% KYMENE<br>0.15% Scripset<br>Water<br>NaOH to vehicle system<br>Mutek charge<br>to <−200 μeq/g.<br>pH of composition >/=<br>pH of vehicle system | 1.2% PVOH<br>0.15% KYMENE<br>0.15% CMC 7MCT<br>Water<br>NaOH to vehicle system<br>Mutek charge<br>to <−200 μeq/g<br>pH of composition >/=<br>pH of vehicle system |
| **System 13** | **System 14** | **System 15** | **System 16** |
| Component 1 (Boom 1)<br>1.33% PVOH<br>0.167% A-3025<br>Component 2 (Boom 2)<br>1.5% Scripset 700<br>Water<br>NaOH to vehicle<br>system Mutek charge<br>to <−200 μeq/g for system<br>Ratio of Boom 1:Boom<br>2 flow rates = 9:1<br>pH of composition >/=<br>pH of vehicle system | Component 1 (Boom 1)<br>1.33% PVOH<br>0.167% A-8115<br>Component 2 (Boom 2)<br>1.5% Scripset<br>Water<br>No NaOH required.<br>Vehicle system Mutek<br>charge <−2500 μeq/g for<br>system.<br>Ratio of Boom 1:Boom<br>2 flow rates = 9:1<br>pH of composition >/=<br>pH of vehicle system | Component 1 (Boom 1)<br>1.33% PVOH<br>0.167% A-6115<br>Component 2<br>1.5% Scripset<br>Water<br>No NaOH required.<br>Vehicle system Mutek<br>charge <−1000 μeq/g.<br>Ratio of Boom 1:Boom<br>2 flow rates = 9:1<br>pH of composition >/=<br>pH of vehicle system | Component 1 (Boom 1)<br>1.33% PVOH<br>0.167% KYMENE<br>Component 2<br>1.5% Scripset<br>Water<br>NaOH to vehicle<br>system Mutek charge<br>to <−200 μeq/g for system.<br>Ratio of Boom 1:Boom<br>2 flow rates = 9:1<br>pH of composition >/=<br>pH of vehicle system |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of producing paper products comprising the steps of:

a) providing a fibrous structure having a first surface and a second surface;

b) providing a drying surface;

c) providing a creping aid composition comprising:

i) a film-forming semi-crystalline polymer; and ii) a vehicle system comprising:

a cationic polymer resin;

a water soluble, anionic film forming polymer; and water;

d ) adjusting the net Mutek charge of the vehicle system to less than about −200 μeq/g solid and the pH of the creping aid composition is greater than the pH of the vehicle system;

e) applying the creping aid composition to contact the drying surface of the fibrous structure;

f) applying the fibrous structure to the drying surface such that the fibrous structure, the creping aid composition and the drying surface are all in contact;

g) removing the fibrous structure from the drying surface.

2. The method of claim 1 wherein the Mutek charge of the vehicle system is less than about −400 μeq/g solid.

3. The method of claim 1 wherein the drying surface is heated.

4. The method of claim 3 wherein the drying surface is a Yankee drier surface.

5. The method of claim 1 wherein the step of removing the fibrous structure from the drying surface is accomplished by creping.

6. The method of claim 3 further comprising the step of cleaning the dryer surface with a cleaning blade after removing the fibrous structure from the drying surface.

7. The method of claim 3 wherein the creping aid system comprises two components:

a) a cationic component containing the cationic resin; and b) a anionic component containing the anionic film-forming polymer; and where the step applying the creping aid composition comprises the application of the cationic component and the application of the anionic component.

8. The method of claim 3 wherein the creping aid composition comprises from about 30% to about 95%, by weight of the total dry solids weight of the system, of the film-forming semi-crystalline polymer, from about 5% to about 95%, by weight of the total dry solids weight of the system of the cationic polymer resin, and from about 5% to about 20%, by weight of the total dry solids weight of the system, of the water-soluble, anionic film-forming polymer.

9. The method of claim 8 wherein the film-forming semi-crystalline polymer is polyvinyl alcohol having a degree of hydrolysis greater than about 88% and a number average molecular weight ranging from about 90,000 to about 140,000.

10. The method of claim 8 wherein the cationic polymer resin is selected from the group consisting of water-soluble thermosetting cationic polyamide resins, cationic resins containing no secondary amines derived from reacting the polyamides of a dicarboxylic acid and methyl bis(3-aminopropylamine) in aqueous solution with epichlorohydrin in a mole ratio of between about 1:0.1 and about 1:0.33, cationic resins characterized by a highly branched structure that lacks reactive intralinker functionality and which has a prepolymer backbone comprised of encapped polyamidoamine, and mixtures thereof.

11. The method of claim 8 wherein the water-soluble, anionic film-forming polymer is selected from the group consisting of copolymers of styrene maleic anhydride disodium salt, carboxymethyl cellulose, and mixtures thereof.

* * * * *